US006851155B2

(12) United States Patent
Dove

(10) Patent No.: US 6,851,155 B2
(45) Date of Patent: Feb. 8, 2005

(54) ROLLER CAGE ASSEMBLY WITH FIXED ROLLER SLEEVE

(76) Inventor: Michael J. Dove, 24115 Lindley St., Mission Viejo, CA (US) 92691

( * ) Notice: Subject to any disclaimer, the term of this patent is extended or adjusted under 35 U.S.C. 154(b) by 97 days.

(21) Appl. No.: 10/276,533

(22) PCT Filed: Apr. 9, 2002

(86) PCT No.: PCT/US02/11057

§ 371 (c)(1),
(2), (4) Date: Nov. 13, 2002

(65) Prior Publication Data

US 2003/0188394 A1 Oct. 9, 2003

(51) Int. Cl.[7] ..... B08B 17/02
(52) U.S. Cl. ..... 15/230.11; 492/13; 492/19
(58) Field of Search ..... 15/230.11; 492/13, 492/16–20

(56) References Cited

U.S. PATENT DOCUMENTS

| | | | | |
|---|---|---|---|---|
| 2,970,366 A | | 2/1961 | Gill | 492/19 |
| 3,115,659 A | | 12/1963 | Church | 15/230.11 |
| 3,228,087 A | | 1/1966 | Stoddart et al. | 492/19 |
| 3,274,637 A | | 9/1966 | Schulze | 401/208 |
| 3,447,184 A | | 6/1969 | McGinley | 15/230.11 |
| 3,711,887 A | | 1/1973 | Chapman | 15/230.11 |
| 3,745,624 A | | 7/1973 | Newman | 492/19 |
| 3,877,123 A | | 4/1975 | Pharris | 492/19 |
| 3,986,226 A | | 10/1976 | Roe et al. | 15/230.11 |
| 4,237,575 A | | 12/1980 | Mlachnik | 15/230.11 |
| 4,295,241 A | * | 10/1981 | Woolcock | 15/230.11 |
| 4,316,301 A | | 2/1982 | Smith et al. | 15/230.11 |
| 4,332,067 A | | 6/1982 | Pearce | 492/19 |
| D269,650 S | | 7/1983 | Allison | D4/122 |
| D293,860 S | | 1/1988 | Smith | D4/122 |
| D305,080 S | | 12/1989 | Morgan et al. | D4/122 |
| 4,897,893 A | | 2/1990 | Barker | 15/230.11 |
| 4,985,959 A | | 1/1991 | Lieberman et al. | 15/230.11 |
| D323,246 S | | 1/1992 | Best et al. | D4/122 |
| 5,090,084 A | | 2/1992 | De Guzman | 15/230.11 |
| 5,210,899 A | | 5/1993 | Goldstein et al. | 15/230.11 |
| 5,345,648 A | | 9/1994 | Graves | 15/230.11 |
| 5,490,303 A | | 2/1996 | Graves | 15/230.11 |
| D376,911 S | | 12/1996 | Zigelboim et al. | D4/122 |
| 5,594,971 A | | 1/1997 | Nelson | 15/230.11 |
| 5,619,769 A | | 4/1997 | Hutt | 15/230.11 |

FOREIGN PATENT DOCUMENTS

| | | | |
|---|---|---|---|
| DE | 3606939 | * | 9/1987 |
| DE | 4030884 | * | 4/1992 |
| DE | 4217979 | * | 12/1993 |
| DK | 113343 | | 3/1969 |
| EP | 389357 | | 9/1990 |
| FR | 1402540 | | 5/1965 |
| WO | 03/086658 | * | 10/2003 |

* cited by examiner

*Primary Examiner*—Mark Spisich

(57) ABSTRACT

A roller cage assembly provides a support for a roller sleeve and consisting of a primary and secondary hub. The inner surface of the primary hub and the inner surface of the secondary hub provides a compression fitting so that a longitudinal tube pressed into the compression fitting on the primary inner hub and pressed into the compression fitting on the secondary inner hub joins primary inner hub to secondary inner hub by the longitudinal tube and results in one complete unit. The circumference of the outer primary hub and the circumference of the secondary outer hub is encircled by the rubber or formed plastic o-ring providing a seal to prevent liquids from entering the inner cavity of the roller cage assembly. Each cage hub assembly encloses the roller sleeve into a fixed and immovable position.

7 Claims, 2 Drawing Sheets

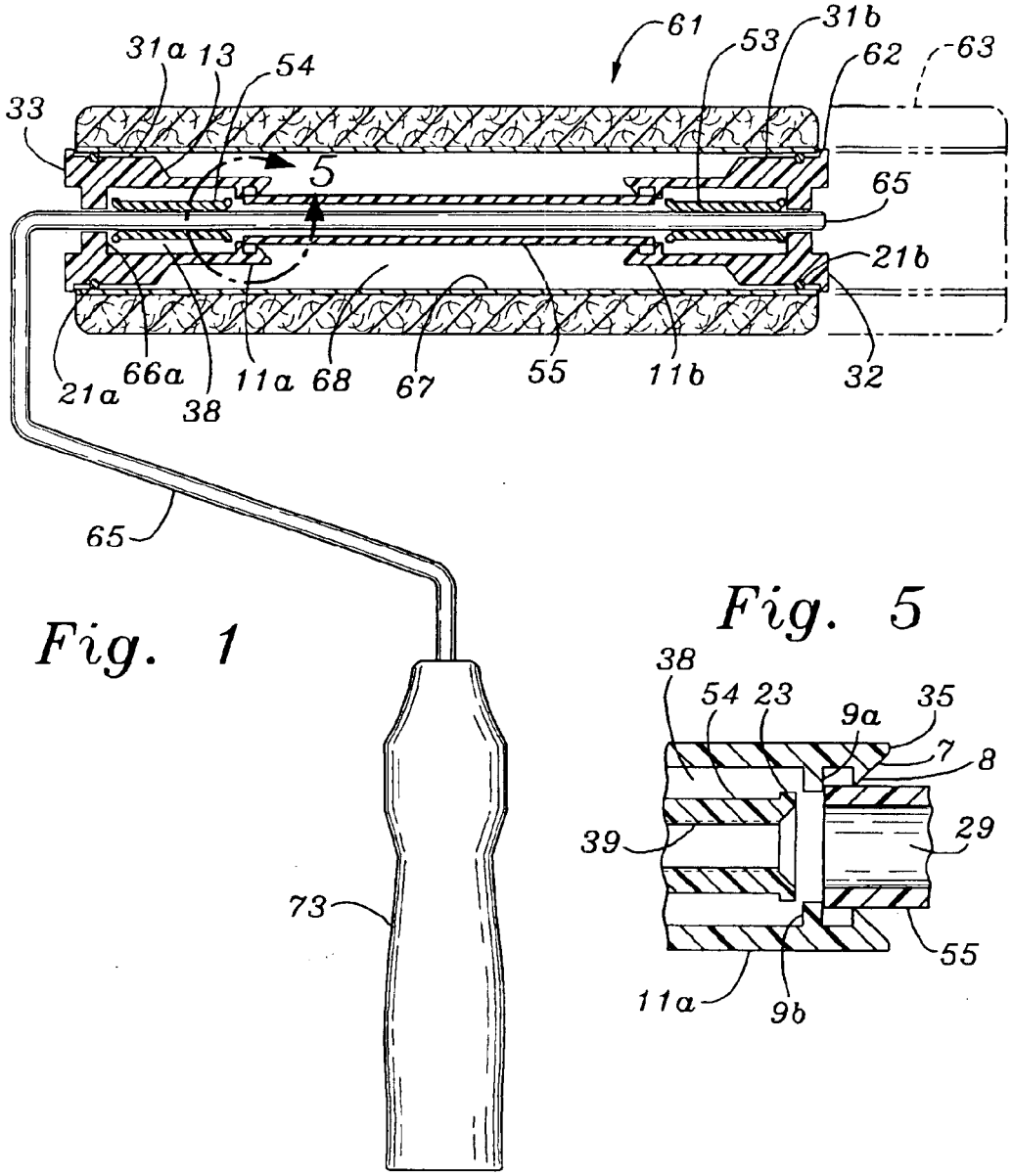
Fig. 1
Fig. 5
Fig. 2
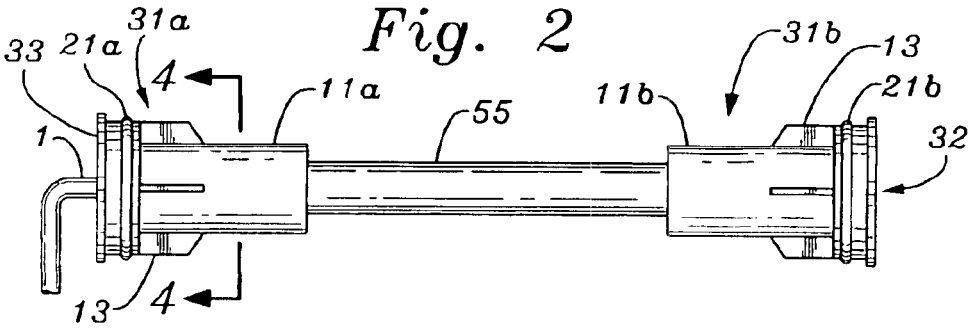

ROLLER CAGE ASSEMBLY WITH FIXED ROLLER SLEEVE

This application is a National Stage Filing under 35 USC §371. This application claims priority under 35 USC §365 and any other applicable statutes, to International Application Ser. No. PCT/US02/11057 having a priority date of Apr. 9, 2002. The aforementioned application is hereby incorporated herein by reference.

DESCRIPTION

This application involves the novelty of a paint roller cage assembly, providing the internal structure for a paint roller sleeve, and sleeve and cage assembly together becomes an inseparable complete paint roller assembly.

BACKGROUND OF THE INVENTION

A typical paint roller, as contemplated for use in the instance of the present invention, comprises a handle, a rod extending from the handle, a cage rotate-ably attached to the rod shaft, the cage further having a handle end and a free end, a cylindrical shaped handle end cap affixed to the end of the cage where the shaft enters the cage from the handle, and a cylindrical shaped free end cap affixed to the other end of the cage where the shaft terminates. Each end cap is attached by four or so spring-biased axial rods that are outwardly bent. A hollow cylindrical paint roller is axially engage able along the shaft, whereby a friction fit interlock occurs between the spring-biased tension rods and the inner face of the cylindrical paint roller. A cylindrical paint roller or paintbrush (also known as a "cover" or "brush") is affixed to and surrounds the cage and part of each end cap in such a manner that the roller or brush, end caps, and cage rotate together. In the normal course of operation, a user grasps the handle and dips the brush in a paint container so that its outer surface absorbs paint. The user then grasps the handle to manually apply the outer surface of the brush to the surface to be painted by rolling it against the surface. Hence the name, paint roller is denoted for its rolling characteristics over a presented surface.

Liquid applicators such as paint rollers have come into very widespread use due to their ability to apply coatings, usually paint, economically and quickly. Nearly every paint roller in commercial use today consists of a frame which terminates at one end in a handle and, at the other end in a cage and cover support rod, a cage received on the support rod, and a roller cover received on the cage. The term "roller" or "paint roller" when used herein will be used to refer to the just described components, namely (1) a frame having a handle and a support rod, (2) a cage and (3) a roller cover.

Operation of present day paint roller assemblies results in the roller element becoming increasingly harder to roll and decreased functionality of paint application occurs as the interior chamber of the roller element becomes loaded with paint, rotating assemblies clog and original intention of moving parts fail.

Thus, the development of the present invention.

In short, the operation of the present day paint roller assemblies result in the following:

1. High production costs. Roller assemblies are largely made of a combination of materials. Most assemblies include wood, metal and plastic or just metal and plastic. The multiplicity of materials has a positive effect on production cost
2. Intricate cage designs. Cage designs have become more complex through the years in an effort to prohibit the roller sleeve from moving away from desired position. This has caused undesirable expenses upon the originator of the product and the consumer.
3. Roller cage longevity. Due to the method that is presently used to join roller sleeve to cage assemblies, the roller cage is assaulted by chemicals and coatings causing clean-up impossibilities and undermining the working and moving parts of the cage. This bombardment relinquishes the mobility of the cage and restricts free movement decreasing the life of the cage and increasing the expense to the user due to frequent replacement of the cage.
4. Roller sleeve not staying in place. Considering the current methods of roller sleeve and cage connections, invariably the roller sleeve will not stay in its desired position. There is a flange on the handle side of the roller cage assembly, but due to the need to place and remove the roller sleeve, it is not possible to have a flange on the engaging end of the roller cage assembly. The present design then, has a built-in failure component that results in wandering roller sleeves.
5. Roller sleeve having to be cleaned inside after each use promotes decomposition of materials. With the sleeve wandering and sliding back and forth, paints attack the core element of the sleeve. Upon every use, liquid, whether water base or solvent base, must be used to clean and purge the interior core member of the roller sleeve. The continuous flood of liquid on this sleeve core, (which incidentally is made primarily of resin coated paper), looses shape and promotes delaminating of core. This premature decomposition forces replacement sooner than would ordinarily be necessary.
6. Paint professionals produce excessive waist discarding failing paint frames and roller sleeves sooner than need be. With the continuous bombardment of paints and liquids on cage and sleeve core, enormous waist is accumulated. Longevity of expensive roller frame assemblies and roller sleeves are cut to a minimum, cutting into profit and filling national land fills with un-needed waist.
7. At the close of each work-day, if proposed paint work is not completed, the roller frames assembly is submersed in paint liquids so that the assembly can be used the following work day. This avoids spending extra time day and prolongs the final cleaning until the paint job is fully completed. Each day, when the frames are used, the submersed paint frame assembly has absorbed paint liquids into the cage cavity to an undesirable degree, causing excessive weight to the frame assembly and un-wanted paint spewing out from each cage end-piece.

SUMMARY OF THE INVENTION

1. Standard size roller cage assembly. The roller cage assembly is comparable to the size of standard roller cage assemblies already on the market. This means that the roller sleeve that attaches to the roller cage is also a standard size and the intended user is familiar with the capacities and defined abilities represented.
2. Production interests are not compromised due to the size of the roller cage. The roller cage will accommodate most standard roller sleeves that are presently on the market. Additionally, the paint professionals that use the existing roller cage assemblies and roller sleeves currently on the market will adapt to this invention easily. This invention complies with current production requirements of paint crews and paint teams nationally due to the standard size of the roller sleeve. Furthermore, this invention will exceed the present expectations that paint professionals have of their current devices.

3. The utility of the invention enables production of 7 inch, 9 inch or 12 inch cage assemblies without additional expense for multiple molds. Due to the design of the roller cage assembly, by shortening or increasing the length of the inner tube, the 7, 9 or 12 inch sleeve can be accommodated. This decreases the die costs involved in production of the product and hence reduces the expense of the final product to the consumer.
4. The roller sleeve is locked into a fixed position. The roller sleeve is pinned between the roller sleeve stop on each hub. This locks the sleeve into an immovable position.
5. Liquid transfer into the cavity of the cage is prevented which enhances the life of the roller sleeve. With the sleeve locked into position, liquid transfer is reduced, but the added rubber or plastic formed bring on the hub, liquid transfer is practically eliminated. Without liquid entering the cavity of the roller cage assembly and liquid constantly attacking the interior core of the sleeve, the longevity of the roller sleeve is enhanced. The replacement of the roller sleeve is held to a minimum.
6. The longevity of the cage is promoted. Due to the elimination of liquid transfer into the cavity of the roller cage assembly, the cage maintains the composure and integrity of its origination.
8. Production costs are limited. Each hub is exactly similar. One mold produces the inner and outer hub. This reduces the cost of production and hence the consumer saves on product purchases.

BRIEF DESCRIPTION OF THE DRAWINGS

The following are descriptions which numerals correspond to the drawing:

FIG. 1 is a sectional view showing internal parts of a paint roller containing the embodiment of the present invention, the roller sleeve being placed in locking position:

FIG. 2 is a perspective view of the cage as shown in section form from FIG. 1:

FIG. 5 is a fragmentary sectional view showing the relationship between the tube, the compression member of the inner hub and the rod keeper inside the hub;

DETAILED DESCRIPTION OF THE DRAWINGS EMBODIMENTS

Figure 3:
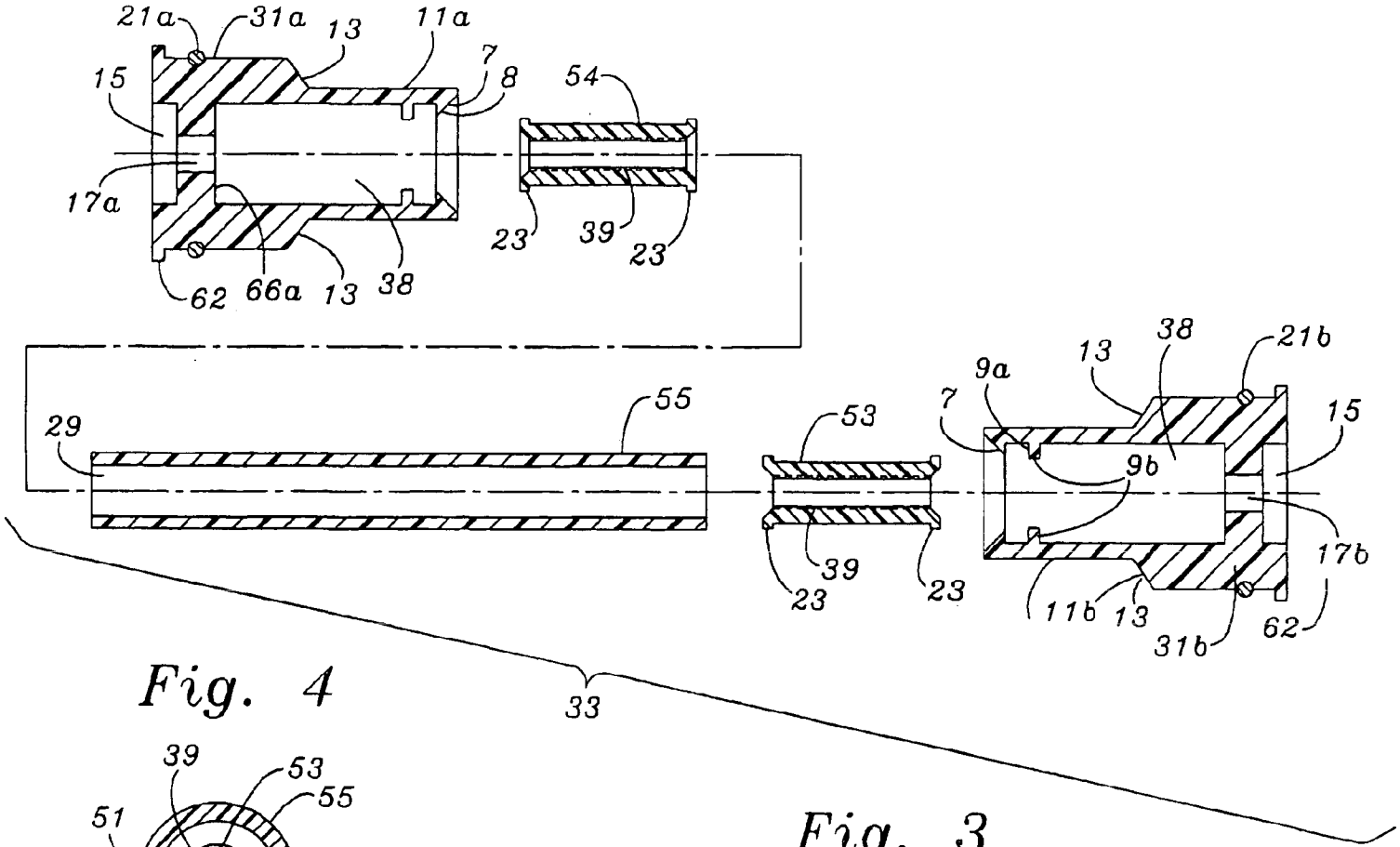
FIG. 3 is an exploded sectional view of the disassembled elements which in their assembled form represent the cage assembly.

Showing in FIG. 1 the paint roller cage assembly 61 includes two hubs, 33 is the outer primary hub and 32 is the outer secondary hub, the primary hub 33 located on the left side of the drawing shown and the secondary hub 32 located on the right side of the drawing shown. The roller sleeve 63 terminates onto each hub, primary 33 and secondary 32. The sleeve 63 is held into position, fixed and immovable, by 62, outer hub stop. 62 is a flange on each hub, primary 33 and secondary 32, forcing the roller sleeve 63 into a fixed position. The sleeve 63 also has pressure placed where inside of roller sleeve 67, rests against 13, roller sleeve support fin and hub surface 21*a* primary rubber o-ring, and 21*b*, secondary o-ring, provide a friction fit to inner sleeve 67. An alternative embodiment for the o-ring 21*a* and 21*b* is a solid plastic o-ring, molded into a fixed position. Whether rubber or solid, the o-ring placement provides a tight fit to reduce liquid transfer into the roller sleeve cavity 68.

31*a* primary hub and 31*b* secondary hub, provides the housing for 54, primary keeper and 53, secondary keeper. The keepers 54, 53 are held into position within the hub cavity FIG. 5 38. The inner hub cavity wall 66*a* and the tube stop interior, FIG. 5 9*b*, maintain the keeper 54 and prevent the keeper 54 from wandering excessively from side to side.

The rod 65, intercourses each keeper 54, 53 without excessive resistance, due to its tapered end. After rod 65, intercourses keeper 54 and 53 into the fill position shown in the diagram, the intercourse surface of the exterior rod surface and the interior keeper surface, FIG. 5 39 holds tight. The keepers 54, 53 grip the rod 65 such that rod 65 resists slipping out of position shown in FIG. 1.

11*a* is the inner portion of the primary hub 31*a* and 11*b* is the inner portion of the secondary hub 31*b*. The inner portion of the hub provides the compression cavity that holds tube 55 into a fixed position.

FIG. 5 is a fragmentary sectional view showing the relationship between the tube 55, the compression cavity of the inner hub 11*a* and the rod keeper 54 inside the hub 31*a;*

The hub cavity 38 provides space for the keeper 54, 53 to move freely. When the rod FIG. 1 65, intercourses into position through the keeper 54, 53, the hub 31*a* and 31*b* with roller sleeve 63, rotate around the keeper 54, 53 and rod 65.

FIG. 5 further shows the relationship the keeper lip 23 and the tube stop interior 9*b*. This relationship provides a stopping point for the keeper 54 to minimize slop in the roller frame assembly 61. The interior keeper wall 39 is smooth and maintains a diameter less than the rod, FIG. 1 65, to produce a tight intercourse. 9*a* is the tube stop exterior. This stop prevents the tube 55 from enclosing upon the inner hub cavity 38 and threatening the mobility of the keeper 54, 53. 35 shows the compression end before tapering to 7 and resulting into a sharp point 8. 8, 7 and 35 jointly enables pressure on all sides of the tube 55, 8 digs into the surface of 55 and prevents 55 from slipping away from 9*a*, and once 55 is fully engaged to 9*a*, 8 digs into the surface not only as an engagement device, but as a device to prevent liquid transfer into cavity FIG. 1 68.

The rod, FIG. 1 65, fits loosely into cavity 29. This loose fit provides mobility of 55 rotation around FIG. 1 65.

FIG. 2 is a perspective view of the cage exterior. 1 shows the bent angle of the rod 65 that intercourses the longitudinal length of the cage and ending at 32. The roller sleeve, FIG. 1 63, is held in place by the pressure produced by friction of 31*a* and 31*b* hub fins. 21*a* and 21*b* shows the rubber o-ring or formed plastic o-ring placement. Due to the irregularity of roller sleeve inner surface 67, 21*a* and 21*b* applies pressure to the inner surface 67 to reduce liquid transfer into sleeve cavity FIG. 1 68.

Figure 4:
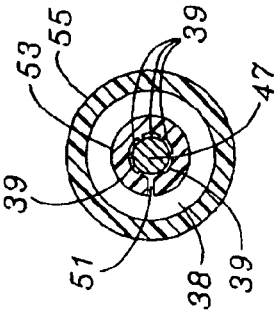
FIG. 4 is a sectional view taken substantially along plane 44 of FIG. 2.

The assembled cage shown in this diagram (FIG. 2), rotates upon the axis of rod FIG. 1 65 freely without slipping off the rod, FIG. 1 65, held tightly by the keepers, FIG. 1 54 and 53. This rotation is exemplified by the cross-section as noted FIG. 2, 4—4, and in FIG. 4, 39 shows the inside diameter of the keeper with pressure applied upon 47, a cross-section of the rod.

Furthermore, the outside diameter of the keeper 54, 53 and the hub cavity 38 allows free rotation and mobility of the keeper 54, 53 inside the cavity 38. The gap in the keeper 53 as shown by 51 allows intercourse between the rod 65 and the keeper wall 39 and expands necessarily for diameter of 47 but maintaining tight grip. 55 shows the wall of the hub that provides the support for the inner keeper mechanisms.

FIG. 3 is an exploded sectional view of the disassembled elements which in their assembled form represent the cage assembly;

15 is the cylindrical opening which leads into the opening of 17*a*, the opening and diameter to receive rod, FIG. 1 65. The rod 65 intercourses 17*a*, the cavity of 38, feels the resistance of the inner wall 39 of keeper 54, penetrates and enters the cavity of 29 freely, feels the resistance again of the inner wall 39 of keeper 53, penetrates and enters the cavity 38 of the secondary hub 31*b* and terminates penetration by ending at 17*b*.

21*a* and 21*b* shows a cross-section of a rubber o-ring or formed plastic o-ring. The o-ring height exceeds the height of the hub exterior, 31*a* and 31*b*, to produce a snug fit of exterior surface of o-ring to interior surface of roller sleeve, FIG. 1 67. This snug fit reduces the risk of liquid transfer into cavity FIG. 1 68.

21*a* and 21*b* is the primary rubber or plastic formed o-ring that reduces liquid transfers, and joins the section that supports 13, the roller sleeve support fin. The inner primary hub 11*a*, 11*b* provides the housing for the compression receptacle 7 and 8 which digs into the exterior wall of 55 and places 55 into a fixed position within the inner hub cavity 38. The tube 55 is stopped from penetrating further into the hub cavity 38 by the tube stop 9*a*.

62 shows the stop which prevents the movement of the inside roller sleeve FIG. 1 67 and forces the sleeve 63 to stay into an immovable position. This stop 9*a* is formed into the primary and secondary hub 31*a*, 31*b* and locks the roller sleeve 63 in place.

The rod, FIG. 1 65 moves freely in the cavity of 55, noted by 29.

When the cage in this diagram is joined together, the complete union represents the cage assembly and it will be understood that the embodiments shown herein are examples of the invention, and it will be apparent to those skilled in the art that numerous variations and modifications may be applied without departing from the spirit and scope of the invention as defined in the appended claims. Therefore, the scope of the invention should not be judged by the foregoing description but instead by the scope of the appended claims as interpreted in accordance with applicable law.

What is claimed is:

1. A roller cage assembly for use with a paint roller handle having a rod, the assembly comprising:

a roller sleeve having a first end and a second end;

a primary and a secondary hub, each hub having an outer portion and an inner portion, the outer portion having a larger diameter than the inner portion and adapted to engage the inner surface of the roller sleeve;

a tube connected between the primary hub inner portion and the secondary hub inner portion;

each of the hubs further including:

an annular tube stop adjacent to but spaced from the free end of the inner portion of the respective hub to define a region within the respective inner portion adapted to frictionally engage the tube interconnecting the hubs, the ends of the tube frictionally engaging an inner surface of the respective hub inner portion, the tube stop and a wall of the respective outer hub portion further defining a cavity, each cavity housing a keeper having a keeper gap allowing expansion of the keeper during intercourse with the rod while facilitating a tight grip between the keeper and the rod, each of the keepers having a size such that they allow free rotational movement of the associated hub thereabout, and wherein the roller sleeve, the primary hub, the secondary hub and the tube are arranged to define a sealed inner cavity, whereby liquid into the cavity is reduced.

2. The roller cage assembly of claim 1, wherein liquid transfer into the inner cavity is prevented.

3. The roller cage assembly of claim 1, wherein the primary hub, the primary keeper, the tube, the secondary keeper, and the secondary hub are adapted to receive the rod.

4. The roller cage assembly of claim 1, wherein the primary hub and the secondary hub are exactly similar.

5. The roller cage assembly of claim 1, wherein the primary hub further comprises a flange for engaging the first end of the roller sleeve, and the secondary hub further comprises a flange for engaging the second end of the roller sleeve.

6. The roller cage assembly of claim 1, wherein each keeper includes at least one keeper lip to minimize friction between the keeper and the respective hub cavity.

7. The roller cage assembly of claim 6, wherein each keeper includes two keeper lips.

* * * * *